United States Patent [19]

Vickery

[11] Patent Number: 4,973,451

[45] Date of Patent: Nov. 27, 1990

[54] FLAME ARRESTING CONDUIT SECTION, COMBUSTOR AND METHOD

[75] Inventor: Earl Vickery, San Jose, Calif.

[73] Assignee: Hoechst Celanese Corporation, Sunnyvale, Calif.

[21] Appl. No.: 196,956

[22] Filed: May 20, 1988

[51] Int. Cl.[5] ..... F23N 1/00

[52] U.S. Cl. ..... 422/110; 422/112; 422/117; 431/5; 431/90; 431/346; 423/210; 432/72; 48/192; 55/DIG. 20; 110/210; 138/41; 220/88 A; 220/88 B

[58] Field of Search ..... 422/110, 117, 112; 431/5, 90, 346; 423/210; 432/72; 48/192; 55/DIG. 20; 110/210; 138/41; 220/88 A, 88 B

[56] References Cited

U.S. PATENT DOCUMENTS

| | | | |
|---|---|---|---|
| 3,711,259 | 1/1973 | Gurney | 431/346 |
| 3,748,111 | 7/1973 | Klose | 431/346 |
| 4,152,399 | 5/1979 | Germerdonk et al. | 431/5 |
| 4,444,109 | 4/1984 | Gifford, Jr. | 431/346 |
| 4,555,389 | 11/1985 | Soneta et al. | 423/210 |
| 4,613,303 | 9/1986 | Willis et al. | 431/346 |

*Primary Examiner*—Robert J. Warden
*Assistant Examiner*—Timothy M. McMahon
*Attorney, Agent, or Firm*—Perman & Green

[57] ABSTRACT

A flame arresting method, conduit section and apparatus for the safe disposal of combustible waste gases from a source such as a reactor. The invention involves providing a waste gas conduit section with a flame-detecting chamber and one or more upstream snuffing chambers divided by flame arresting grid members, and automatically introducing snuffing gases to the snuffing chamber(s) whenever a flame is detected in the flame-detecting chamber. The outlet from the waste gas conduit section opens to a combustion chamber, for incineration purposes, or to a scrubber.

25 Claims, 2 Drawing Sheets

FLAME ARRESTING CONDUIT SECTION, COMBUSTOR AND METHOD

BACKGROUND OF THE INVENTION

The present invention relates to the prevention of uncontrolled fire and/or explosion in waste gas disposal devices designed for the purging and/or controlled incineration of combustible waste gases, such as by-products of a reaction process.

Reference is made to my U.S. Pat. No. 4,661,056, issued Apr. 28, 1987, for its disclosure of an apparatus which is designed for the controlled incineration of waste gases and which functions by introducing the combustible waste gases under low pressure to an air conduit, through a controlled combustion conduit in which the waste gases are mixed with swirling air, ignited and then drawn into the air conduit and conveyed through a scrubber at the exit end of the air conduit for release as non-combustible reaction products.

Controlled combustion devices and purging devices for combustible waste gases must be capable of operation under low pressures since such waste gases commonly are by-products of reactions which take place at or slightly above atmospheric pressure and which require the laminar flow of combustible reaction gases or by-product gases through the reactor. Any attempt to increase the pressure of the waste gases as they enter the controlled combustion conduit can lead to back-pressure problems within the reactor. However, the exposure of the combustible waste gases at relatively low pressures, i.e., atmospheric or only slightly higher, to the ignition means in a combustion chamber, in the case of controlled combustion devices, or to an unintentional spark or other accidental ignition source within the transport conduit or scrubber, in the case of non-incineration purging systems, creates the danger that the controlled fire within the combustion conduit or accidental fire within the conduit might flash back upstream through the reactor exhaust pipe into the reactor or other processing equipment creating disruptive and possibly dangerous conditions. The flame propagation rate of hydrogen, for example, is about 8.25 feet per second, which permits the flame to travel upstream against the low pressure flow of a waste gas containing hydrogen.

The apparatus of my aforementioned Patent is an incineration apparatus which assists the mixing of air with the waste gas by creating a swirling action and vacuum within the air conduit, at the downstream end of the waste gas conduit, beyond a combustion chamber. However, such operation does not protect against high speed flame propagation or flash back.

It is known to use various commercially-available flame arresting devices and barriers within a combustion conduit in an effort to prevent flame from flashing back to the combustible gas inlet. Reference is made to U.S. Pat. Nos. 3,711,259 (porous, metal-coated plastic foam barrier); 3,748,111 (flame-arresting screen); 4,152,399 (fire screen); 4,444,109 (flame arresting membrane barrier); 4,555,389 (porous filler barrier and inert gases), and 4,613,303 (valved air screen). The devices of each of these patents are subject to failure in the event of malfunctions, and have no backup means to render them fail-safe. They rely upon the ability of a flame-arresting barrier to prevent flame from passing therethrough whereas such barriers are not completely reliable for this purpose against the high speed of flame propagation or flash back, particularly in the event of a malfunction, such as in the air supply means. Unless there is a sufficient rate of flow past the flame arrestor to maintain the flame at or downstream of the ignition source, the flame can burn in the upstream direction, permeate the flame arrestor and ignite a combustible mixture of the waste gas and air upstream of the flame arrestor, i.e., can flash back to the waste gas inlet. In such event the reaction apparatus must be shut down or diverted in order to stop feeding the combustible gasses to the combustor.

SUMMARY OF THE INVENTION

Figure 1:
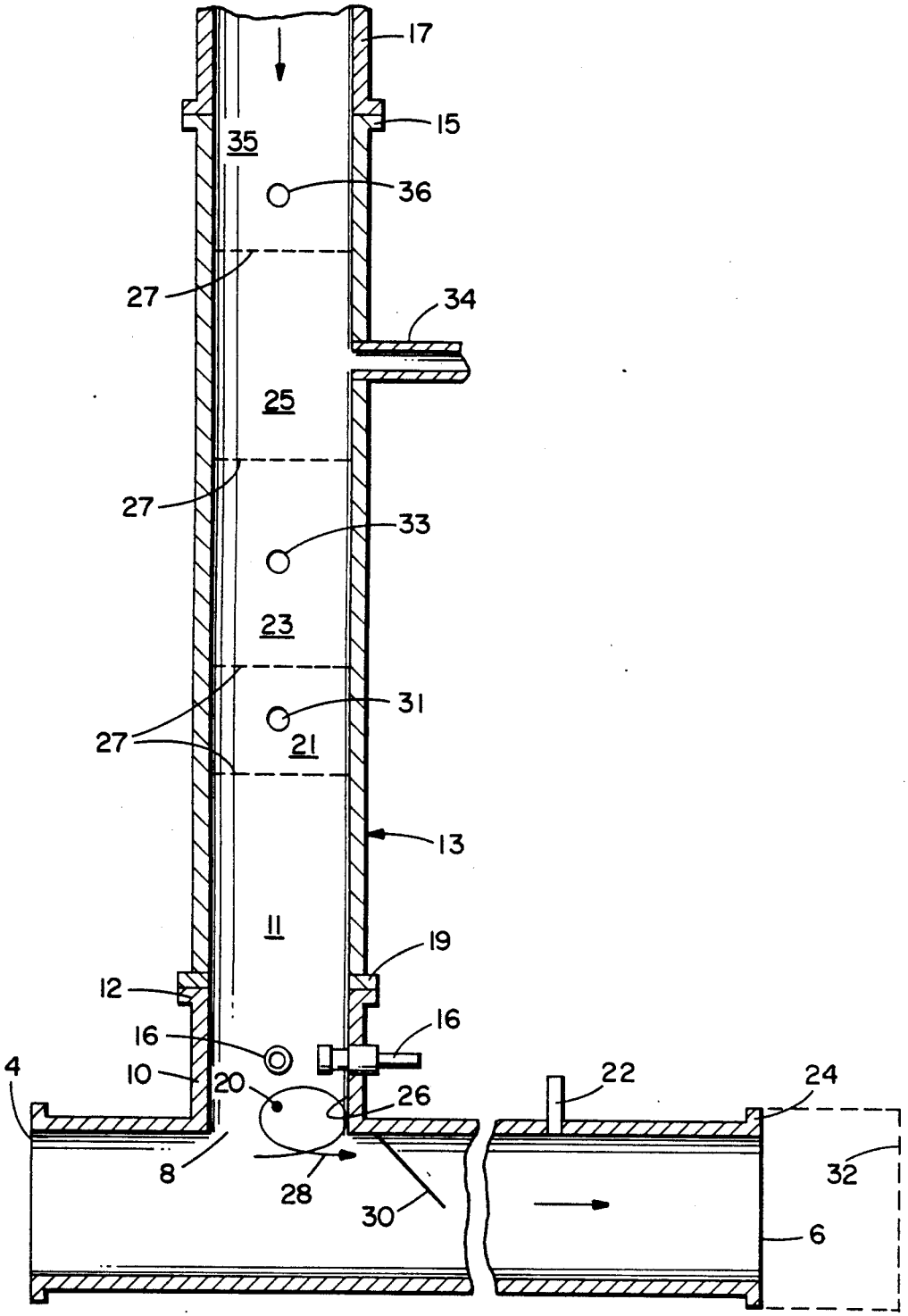
FIG. 1 is an elevational cross-section illustrating an apparatus according to an embodiment of the present invention.

The present invention provides a relatively fail-safe flame arresting element designed for use in a waste gas purging conduit to a scrubber, which conduit may be associated with a combustor for the controlled combustion of the combustible waste gases, for the safe disposal of waste gases from a source, such as a reaction chamber. The flame arresting element comprises a conduit section having at least one primary waste gas inlet at an upstream end, a downstream outlet end which, in the case of incineration systems, is open to a combustion chamber containing an ignition source, and in the case of non-incineration purging systems, opens to a transport conduit to a scrubber or other safe disposal unit. The present flame arresting device comprises at least one gas-permeable flame detection chamber located upstream of the waste gas outlet end, and at least one gas-permeable snuffing chamber located upstream of the flame detection chamber and downstream of the waste gas inlet end of the conduit section. The detection chamber comprises a spaced pair of flame arrestors such as screen elements which are permeable to the waste gases and permit them to be forced and/or drawn freely therethrough to the transport conduit or to the combustion chamber and ignition source for the controlled burning thereof, with release of the smoke and ignition products into the transport conduit which, in the case of controlled incineration devices, is an air conduit providing air to support the combustion.

The invention is characterized by the presence of a flame detecting device within the permeable detection chamber, and secondary gas inlet means, within or upstream of the detection chamber and associated with the flame detecting device, for introducing non-combustible snuffing gas to the snuffing chamber(s) for transport to the detection chamber from one or more points upstream thereof in order to render the total gas mixture within the detection chamber non-combustible whenever the presence of flame is detected in the detection chamber. According to a preferred embodiment of the invention, a plurality of adjacent, in-line, gas-permeable chambers are provided, each one comprising a spaced pair of flame-arresting, gas-permeable elements, such as screens. The downstream chamber, inwardly of the exit end of the conduit element and upstream of the combustion chamber and ignition source in the case of controlled incineration systems, comprises the flame detecting device. One or two adjacent upstream chambers comprise the secondary gas inlets for introducing the non-combustible snuffing gas, such as nitrogen, Freon or carbon dioxide, directly thereto, just upstream of the flame detecting chamber and downstream of the primary waste gas inlet(s) through which the combustible waste gas is introduced. Thus, whenever the conditions within the flame-arresting conduit element permit a flame to propagate upstream, past the downstream flame arrestor screen of the detecting chamber, the flame is detected to activate the introduction of the snuffing gas into one or more adjacent upstream gas-permeable chambers. This prevents any further upstream propagation of the flame and rapidly smothers the flame within the detection chamber as the non-combustible gas expands into and through the detection chamber to the transport conduit or to the combustion chamber and into the air conduit for discharge.

According to another embodiment of the invention, a gas pressure-sensing means is associated with the upstream end of the elongate flame arrestor conduit section in order to detect any back pressure which may develop as a result of restriction or degradation in the flow of the waste gas downstream to the combustion chamber or to the transport conduit. Such a restriction may be caused by the accumulation of incineration products within or on one or more of the gas-permeable flame-arresting grid members or screens, and these members or screens and the conduit section are preferably removably-attached to permit the convenient removal of the screens for replacement or cleaning purposes. The accumulation of solid incineration products is common in cases where the waste gas includes gases such as silicon tetrachloride which produce solid reaction products upon incineration. This problem is more common in controlled incineration systems than in non-incineration purging systems.

DETAILED DESCRIPTION

A preferred embodiment of the present invention provides an improved, fail-safe apparatus for the incineration of combustible gases, particularly gases which are pyrophoric. The present apparatus is particularly suitable for the incineration of mixtures of hydrogen and silane gases which are reaction by-products generated during the manufacture of semiconductor devices such as computer chips and, as such, contain dangerous waste dopants such as arsine and phosphine which are used in such manufacture.

However, the present invention is also useful in non-incineration systems for purging waste gases through a transport conduit to a scrubber or other safe disposal unit since, in such systems, the danger of unintentional ignition exists as may be caused by a spark from a motor, static or other accidental ignition source. As discussed hereinbefore, the flame propagation rate of combustible gases, such as hydrogen, is so rapid that the flame can propagate upstream, against the relatively low pressure flow of the waste gas, presenting the danger of flashing back through the reactor exhaust pipe or other source, creating disruptive and dangerous conditions.

Referring to the accompanying drawing which shows a preferred embodiment, the combustor or incineration apparatus thereof comprises a first conduit 2 which is identical to that of my aforementioned U.S. Pat. No. 4,661,056 in that it has entrance and exit ends 4 and 6, and a gas inlet 8 enclosed by a second or branch conduit 10 having a flanged entrance 12. The area of branch conduit 10 between the flanged entrance 12 and the air inlet 8 comprises a combustion chamber containing one or more ignition means 16, such as spark-emitting plugs and an ignition or flame detector 20. Preferably, but not necessarily the air conduit 2 includes a baffle plate 30 or restriction in order to cause a portion of the air flowing through conduit 2 to flow against the downstream inside wall area 26 of the branch conduit 10, creating a swirl 28 of the combustion supporting air up into the combustion chamber 11 to assist mixing with the waste gases, and also creating a vacuum to assist discharge into the air flow within conduit 2 to carry the smoke and ignition products downstream, past a temperature sensor 22, to the flanged exit 24 and attached scrubber device 32.

The essential features of the apparatus illustrated by the drawing are present within the flame arrestor conduit section 13 which is designed to be interposed as a section of the waste gas conduit which conveys waste gas from a reactor or other source to a combustion chamber, such as 11, for safe incineration and discharge, such as into an air flow conduit 2 to a scrubber 32.

The flame arrestor conduit section 13 illustrated in FIG. 1 has a flanged upstream entrance end 15 sealingly engaged with a waste gas conduit 17, and a flanged downstream exit end 19 sealingly engaged with the branch conduit 10 enclosing the combustion chamber 11.

The flame arrestor conduit section 13, in the illustrated embodiment, contains three screened compartments 21, 23 and 25, each formed and enclosed by a pair of spaced flame-arresting grid members or screens 27, each of which comprises a radial barrier or gas-permeable restriction through which the waste gases must pass as they are forced and/or drawn through the combustion chamber 11 into the air flow through the air conduit 2. Preferably the screens 27 are removably-secured within the flame arrestor conduit 13, such as by means of snap rings which expand into annular grooves in the interior wall of the conduit section 13, or by other suitable means, and the conduit 13 is removably-attached to permit access to the screens 27 for replacement purposes.

Figure 2:
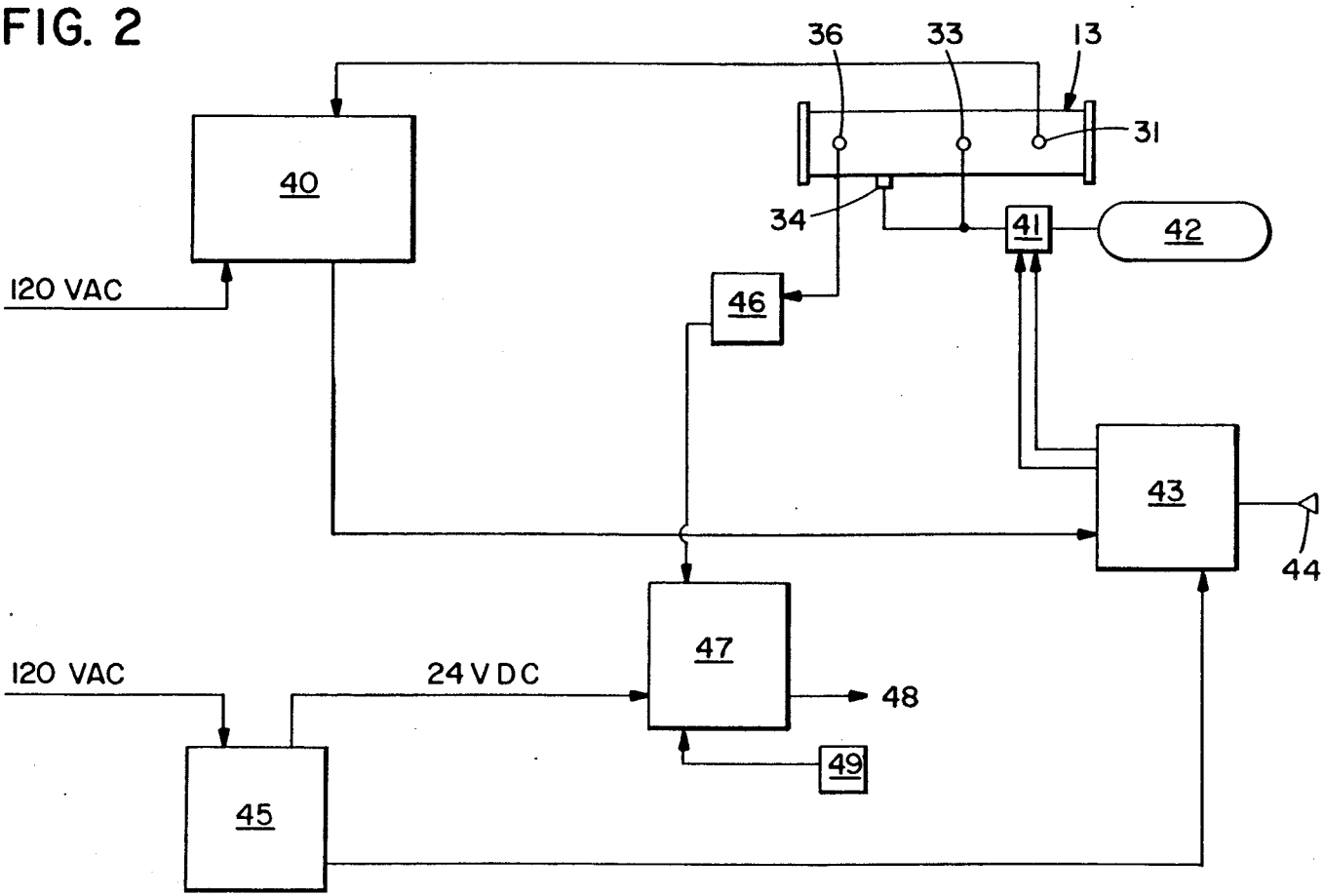
FIG. 2 is an illustration of an electrical circuit suitable for the automatic operation of the apparatus of FIG. 1.

Located within the last downstream screen-enclosed chamber before the exit end to the combustion chamber 11, namely chamber 21, is a conventional flame-detecting device 31 such as a thermocouple which is designed to sense the presence of any flame which happens to travel upstream from the combustion chamber 11, through the first screen 27, or which ignites within chamber 21 due to the presence of a combustible gas mixture therewithin, and which is associated with an adjustable temperature comparator 40 such as a temperature display with settable point, as shown on FIG. 2.

Opening into the next upstream screened chambers 23 and 25 of the waste gas conduit section 13 are snuffing gas inlet pipes 33 and 34, each of which is associated through an electrically-operated solenoid value means 41, with a pressurized source 42 of a combustion-smothering or snuffing gas, such as nitrogen, Freon, carbon dioxide, etc. The gas preferably is in pressure-liquified or compressed form to provide an endothermic vaporization which reduces the temperature in the snuffing chambers 23 and 25, shown in FIG. 1, at the same time as it displaces any combustible gas mixture therefrom.

As will be clear to those skilled in the art, the flame detector is a conventional electronic device which generates an electrical signal in the presence of a flame, which signal is transmitted to the temperature comparator 40 and, if it is above the trip setting thereof, it is transmitted to a timed latching relay 43 which activates the solenoid valve 41 immediately for a set time period, such as 45 seconds, and may also activate an audible alarm 44, as illustrated by FIG. 2. Relay 43 is powered from a power source through a transformer 45, as shown, and activates the solenoid valve 41 immediately to a fully open position for the timed period and then reactivates it to closed position after the set time delay period in order to conserve the snuffing gas. If the presence of flame is still being detected, or if the flame reoccurs in the detection chamber, the detector reactivates the latching relay 43 to reopen the solenoid for another timed period. This recycling continues until no flame is present in the detection chamber. The valve means 41, which normally closes off the snuffing gas inlet pipes 33 and 34, is switched to open position for the timed period or periods to permit snuffing gas to flow from source 42 into the chambers 23 and 25. The flame detector may comprise a type K thermocouple, an infrared radiation detector or an ultraviolet radiation detector, depending upon the composition of the waste gas being incinerated. Also, the flame detector may be associated with an audible alarm 44 and/or with a controller for shutting off the flow of flammable waste gas or for diverting it to a scrubber or to another incinerator or to a temporary storage container.

The introduction of snuffing gas is initiated simultaneously into both snuffing chambers 23 and 25 to produce preferably cold atmospheres therewithin which will not support combustion, thus preventing flame from entering through the downstream screens 27 thereof, either flame from a combustion chamber, as illustrated, or accidental flame which may ignite in a transport conduit to a scrubber, in non-incineration systems. Moreover, the continued flow of waste gases through the upstream gas conduit 17 forces the snuffing gas downstream into the flame detector chamber 21, to displace any combustible gas mixture therefrom into the combustion chamber 11 or transport conduit to the scrubber. At this time the flame detector 31 and comparator 40 will deactivate the signal to relay 43, in the absence of flame within chamber 21, and the valve 41 to the snuffing gas source 42 will re-close to cut off the further supply of snuffing gas to chambers 23 and 25.

The flame arrestor grid members or screens 27 are known devices which are conventionally-used individually in conduits carrying explosive mixtures of fuel gas and air to burners. They are intended to prevent a flashback from reaching equipment not strong enough to withstand explosion pressure. Flame arrestors are commercially-available from C.M. Kemp Manufacture Co., Combustion Products Div., Glen Burnie, Md., under the designation Type QA, and from Sales Corp. of America, Dresher, PA., under the designation Type AF-8A.

The present screens 27 preferably are so-called 60% screens, which reduce the cross-section by 40%. The screens 27 enclosing the flame detector chamber 21 preferably are spaced by about 1.5 to 2 inches while the screens 27 enclosing the snuffing chambers 23 and 25 are preferably spaced by about 3 to 4 inches, the conduits 2, 10, 13 and 17 preferably being about 2 inches each in inside diameter.

As also shown in FIG. 1, the upstream inlet end of the waste gas flame arrestor conduit section 13 comprises a waste gas inlet chamber 35 containing a back-pressure sensor 36 which detects small increases of gas pressure within chamber 35, indicative of an increased resistance to the flow of the waste gases through the screens 27 caused by the gradual deposit of incineration solids on or within the screens. This is an important consideration in cases where the waste gases are ones which are capable of forming solid reaction products when burned. In such cases, the solids can be deposited on the screens, most particularly the downstream screen 27 adjacent the combustion chamber 11, to increase the resistance to the waste gas flow. When this occurs the waste gas pressure will increase in chamber 35 and the back-pressure sensor 36 will transmit a signal to an adjustable pressure comparator 46 which will trip at an excessive pressure to activate a latching relay 47 and energize a warning light 48 and if desired, will cut off or divert the incoming flow of waste gases directly to a scrubber or to another incinerator or to a temporary storage container so that the flame arrestor conduit section can be removed for replacement or cleaning of the flame arrestor screens. Manual latch reset 49 is provided to reset relay 47 after the emergency conditions have passed.

It is to be understood that the above described embodiments of the invention are illustrative only and that modifications throughout may occur to those skilled in the art. Accordingly, this invention is not to be regarded as limited to the embodiments disclosed herein, but is to be limited as defined by the appended claims.

What is claimed is:

1. An apparatus for receiving and safely disposing of combustible gases, which comprises an elongate flame arrestor conduit section having (a) an upstream inlet end for receiving a supply of combustible waste gas to be disposed; (b) a downstream outlet end for discharging the waste gas for disposal; (c) at least one spaced pair of gas-permeable flame-arresting grid members located upstream of said outlet end and forming a detection chamber within said flame arrestor conduit section through which said combustible waste gas must pass; (d) a flame-detecting means within said detection chamber for sensing the presence of any flame which might travel upstream through the downstream grid member of said detection chamber; (e) snuffing gas inlet means opening into said flame arrestor conduit section at a location at or upstream of said flame-detecting means; and (f) means associated with said flame-detecting means for activating the introduction of a snuffing gas through said snuffing gas inlet means into said flame arrestor conduit section to render the gas mixture therewithin non-combustible in response to the actuation of said flame detecting means.

2. An apparatus according to claim 1 further comprising a controlled incineration apparatus which further includes a combustion chamber adjacent the outlet end of the flame arrestor conduit section and including means for introducing a supply of a combustion-supporting gas thereto to produce a combustible gas mixture with said waste gas, and a means for igniting said combustible gas mixture within said combustion chamber.

3. An apparatus according to claim 2 in which the outlet end of the elongate combustor conduit opens into a gas conduit carrying a continuous supply of a combustion-supporting gas, such as air, said gas conduit being the means for introducing the supply of combustion-supporting gas to the combustion chamber and also being an outlet into which the incineration products are discharged from the combustion.

4. An apparatus according to claim 1 in which at least one additional gas-permeable flame-arresting grid member is present within said elongate flame arrestor conduit section, spaced upstream of said detecting chamber to form a snuffing chamber through which the combustible waste gas must flow to said detecting chamber, said snuffing gas inlet means opening into said snuffing chamber.

5. An apparatus according to claim 4 in which two additional gas-permeable flame-arresting grid members are present within said elongate combustor conduit the second additional grid member being spaced upstream of the first additional grid member to form a second upstream snuffing chamber through which the combustible waste gas must flow to said first snuffing chamber and to said detecting chamber, a second snuffing gas inlet means opening into said second snuffing chamber.

6. An apparatus according to claim 1 in which said flame-detecting device is an electrical component which emits an electrical signal when actuated, which signal causes a valve means to open between the snuffing gas inlet means and a supply of said snuffing gas.

7. An apparatus according to claim 6 in which said electrical component comprises a heat sensitive thermocouple.

8. An apparatus according to claim 6 in which said electrical component comprises an infrared radiation-detecting device.

9. An apparatus according to claim 6 in which said electrical component comprises an ultraviolet radiation-detecting device.

10. An apparatus according to claim 1 in which said flame-detecting means is also associated with a means for cutting off the supply of waste gas to the flame arrestor inlet end when the flame-detecting means senses the presence of a flame within the detection chamber.

11. An apparatus according to claim 1 in which said flame-arresting grid members are removably - attached within said elongate flame arrestor conduit section to permit removal for cleaning and/or replacement purposes.

12. An apparatus according to claim 1 in which said elongate conduit section includes a gas pressure sensing means at the upstream end thereof in order to detect any increase in the gas pressure therein, indicative of a downstream flow restriction.

13. An apparatus according to claim 1 further comprising a waste gas transport conduit associated with the outlet end of the flame arrestor conduit section for transporting the waste gas to a scrubber.

14. A flame arrestor conduit section designed to be interposed as a section of the length of a waste gas disposal conduit between a waste gas supply conduit and a means for safely converting the waste gas to a more harmless condition, said flame arrestor conduit section having an upstream inlet end for engagement with a waste gas supply conduit to receive waste gas therefrom, a downstream outlet end for discharging the waste gas to a means for converting the waste gas to a more harmless condition, at least one spaced pair of gas-permeable flame arresting grid members located adjacent the downstream outlet end forming a detecting chamber within said conduit section through which the waste gas must flow, a flame-detecting means within said detection chamber for sensing the presence of any flame therewithin; at least one snuffing gas inlet means opening into said flame arrestor conduit section at a location at or upstream of said detecting chamber, and electrical means associated with said flame-detecting means and said snuffing gas inlet means for causing a supply of snuffing gas to flow through said inlet means into said upstream location of said conduit section when said flame detecting means detects the presence of a flame within said detecting chamber.

15. A flame arrestor conduit section according to claim 13 in which said means for converting the waste gas comprises the combustion chamber of a combustor to which the waste gas is conveyed for incineration and discharge.

16. A flame arrestor conduit section according to claim 14 in which at least one additional gas permeable flame arresting grid member is present within said conduit section at a location spaced upstream of said snuffing gas inlet means to form a gas permeable first snuffing gas chamber adjacent to said detecting chamber.

17. A flame arrestor conduit section according to claim 16 in which two additional gas permeable flame arresting screens are present in spaced relation within said conduit section to form first and second adjacent gas permeable snuffing gas chambers, and a second snuffing gas inlet means is provided which opens into the second snuffing chamber and is also associated with said electrical means and said flame detecting means to cause a supply of snuffing gas to flow into said first and second snuffing gas chambers as a result of the detection of a flame within the flame detecting chamber.

18. A flame arrestor conduit section according to claim 14 which further comprises a gas pressure sensing means at the upstream inlet end thereof for detecting any increase in the gas pressure therewithin, indicative of a downstream flow restriction.

19. A method for preventing the upstream propagation of a flame within a waste gas conduit having an upstream inlet end through which a combustible waste gas is admitted, at least one gas-permeable flame-arresting grid member, and a downstream outlet end from which the waste gas is discharged to a means for converting it to a more harmless condition, which method comprises providing a flame arresting conduit section having a gas-permeable detecting chamber containing a flame detecting means upstream of said outlet end, locating a snuffing gas inlet means within said flame arresting conduit section at a position at or upstream of said flame detecting means, and introducing a snuffing gas through said inlet means upon the detection of a flame within said detecting chamber by said flame detecting means, whereby the snuffing gas atmosphere within the flame arresting conduit section, upstream of the flame detecting means, snuffs the flame and thereby prevents the migration of the flame to the upstream inlet end of the conduit.

20. Method according to claim 19 in which said gas-permeable detecting chamber is formed by inserting a spaced pair of gas-permeable flame-arresting grid members within the conduit section through which the combustible waste gas must flow to the outlet end of the conduit section.

21. Method according to claim 19 which comprises providing at least one gas-permeable snuffing chamber upstream of said detecting chamber, and introducing snuffing gas to said snuffing chamber whenever the presence of a flame is detected by the flame detecting means present within the detecting chamber.

22. Method according to claim 21 which comprises forming said gas-permeable snuffing chamber by inserting a spaced pair of gas-permeable flame arresting grid members within the flame arresting conduit section, through which the combustible waste gas must flow to the detecting chamber, and introducing said snuffing gas between said grid members directly into said snuffing gas chamber.

23. Method according to claim 20 which further comprises sensing the gas pressure at the upstream end of said flame arresting conduit section, and cleaning or replacing the said grid members whenever a back pressure is detected, indicative of a gas flow restriction through said grid members.

24. Method according to claim 19 which comprises discharging the waste gas from the outlet end of the flame arresting conduit section into a combustion chamber containing an ignition source to incinerate the waste gas and discharging the incineration products in a discharge conduit.

25. Method according to claim 19 which comprises discharging the waste gas from the outlet end of the flame arresting conduit section for transport to a scrubber.

* * * * *